US006648329B2

(12) United States Patent
Tsai

(10) Patent No.: US 6,648,329 B2
(45) Date of Patent: Nov. 18, 2003

(54) ROTARY BAR OF GAME TABLE

(76) Inventor: Lore Tsai, No. 22, Lane 20, Zichiang Street, Taichung (TW)

( * ) Notice: Subject to any disclaimer, the term of this patent is extended or adjusted under 35 U.S.C. 154(b) by 0 days.

(21) Appl. No.: 10/128,299

(22) Filed: Apr. 24, 2002

(65) Prior Publication Data

US 2003/0168800 A1 Sep. 11, 2003

(30) Foreign Application Priority Data

Mar. 6, 2002 (TW) ..... 91104107 A

(51) Int. Cl.[7] ..... A63F 7/06

(52) U.S. Cl. ..... 273/108.51; 273/108.52; 273/119 R; 273/129 R

(58) Field of Search ..... 273/108.1, 108.2, 273/108.21, 108.22, 108.3, 108.31, 108.32, 108.33, 108.4, 108.41, 108.5, 108.51, 108.52, 108.53, 108.54, 108.55, 108.56, 129 R, 129 S, 129 T, 129 V, 129 W, 119 R, 126 R

(56) References Cited

U.S. PATENT DOCUMENTS 3,105,687 A * 10/1963 Munro
3,475,028 A * 10/1969 Rodorigo
4,065,128 A * 12/1977 Gomori
4,146,224 A * 3/1979 Deutsch
4,304,405 A * 12/1981 Laine
4,311,309 A * 1/1982 Bradley
4,480,833 A * 11/1984 Barcelow
4,691,921 A * 9/1987 Iseki
4,976,434 A * 12/1990 Wikner
5,040,794 A * 8/1991 Albrecht
5,046,734 A * 9/1991 Laine
5,433,443 A * 7/1995 Ples
5,655,767 A * 8/1997 Francis
6,302,394 B1 * 10/2001 Chou
6,464,220 B1 * 10/2002 Tsai

* cited by examiner

*Primary Examiner*—Sebastiano Passaniti
(74) *Attorney, Agent, or Firm*—Troxell Law Office PLLC

(57) ABSTRACT

A rotary bar for a game table, which is mounted on the table body of the game table. A predetermined number of dolls are mounted on the rotary bar. The rotary bar includes an inner bar and an outer bar in which the inner bar is slidably nested. One end of the inner bar extends out of the outer bar for holding. Two ends of the outer bar are mounted on the table body. When turning the inner bar, the outer bar and the inner bar are synchronously rotated. A transmission device is disposed in the outer bar. An inner end of the inner bar is connected with transmission device. The dolls are slidably fitted around the outer bar and rotatable along with the outer bar. When the inner bar is pushed and pulled, the transmission device transmits the moving power of the inner bar to the dolls to move the dolls along the outer bar.

42 Claims, 12 Drawing Sheets

Piror Art

ROTARY BAR OF GAME TABLE

BACKGROUND OF THE INVENTION

The present invention is related to a game table, and more particularly to a rotary bar of game table such as soccer table and hockey table. A player can operate the rotary bar to drive dolls to move or rotate for driving a ball. The rotary bar is able to magnify the operation travel of the player, whereby the movement of the dolls is larger than that of the rotary bar operated by the player.

FIG. 1 shows a conventional soccer table or hockey table 10. Multiple rotary rods 14 are passed through the walls of the table body 12. One or more dolls 16 are disposed on each rotary rod. A user can push or pull the rotary rod 14 to move the dolls 16 and turn the rotary rod 14 to rotate the dolls 16 for driving a ball body on the table body.

In the conventional game table, the rotary rod 14 and the dolls 16 are moved by equal travels. That is, the movement of the rotary rod is equal to the movement of the dolls. In the game, the moving speed of the dolls is critical. However, the travel of the rotary rod is equal to that of the dolls so that it is hard for a player to quickly enough move the dolls, especially in a large-size game table.

Moreover, the conventional rotary rod is a simple rod, the movement of the dolls is equal to that of the operation end 141 and tail end 142 of the rotary rod 14. Therefore, the game table must be placed in a sufficiently large room permitting the two ends 141, 142 of the rotary rod to extend. This leads to waste of space. In addition, when extended, the tail end 142 of the rotary rod is easy to hit and hurt a player.

SUMMARY OF THE INVENTION

It is therefore a primary object of the present invention to provide a rotary bar of game table, by which the operation travel of a player is unequal to the movement of the dolls disposed on the rotary bar. Accordingly, the movement of dolls is several times the operation travel of the player. Therefore, the moving speed and movement of the dolls are increased.

It is a further object of the present invention to provide the above rotary bar of game table, by which the game table can be used in a smaller room.

The present invention can be best understood through the following description and accompanying drawings wherein:

DETAILED DESCRIPTION OF THE PREFERRED EMBODIMENTS

Figure 1:
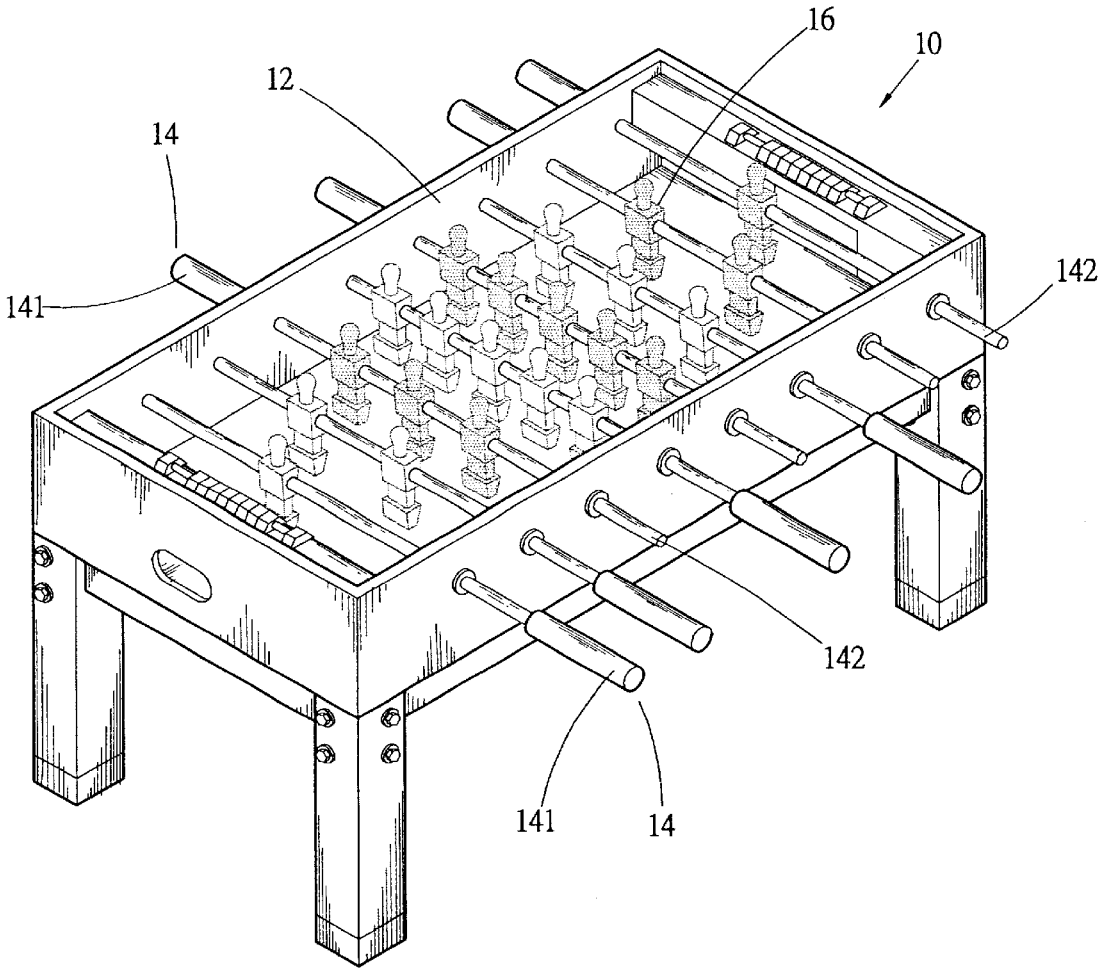
FIG. 1 is a perspective view of a conventional soccer table.
Figure 2:
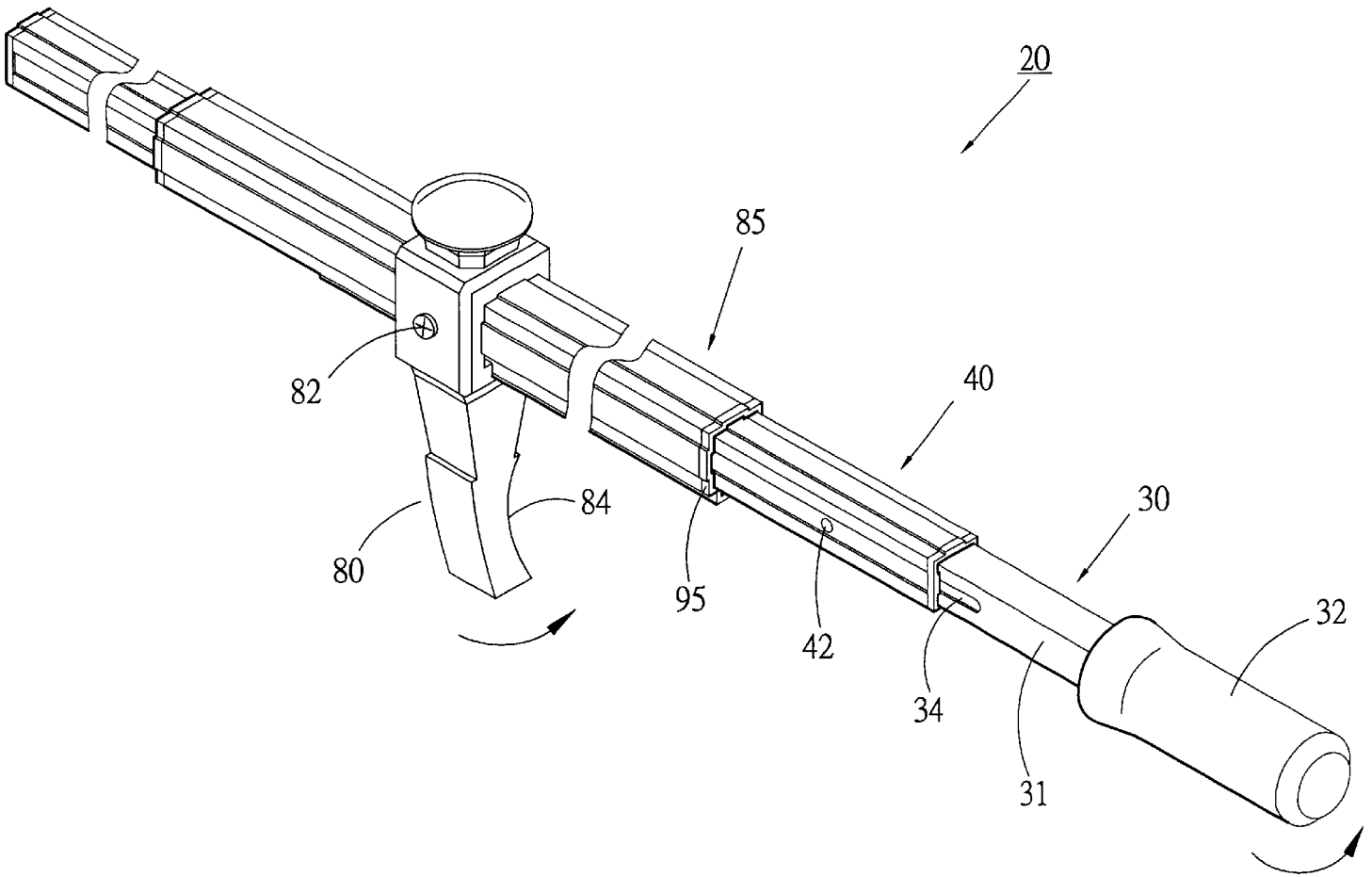
FIG. 2 is a perspective view of a preferred embodiment of the present invention.
Figure 3:
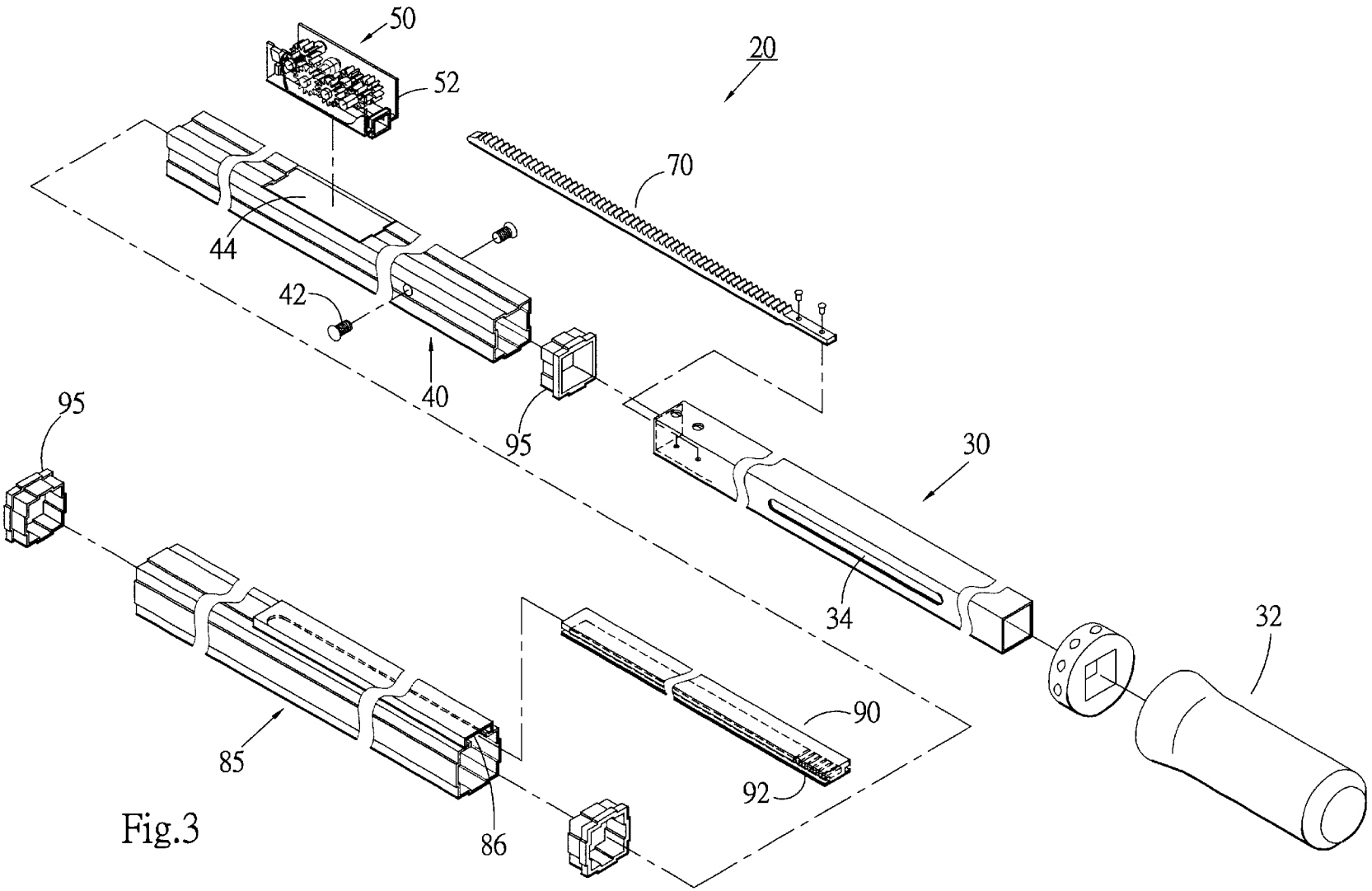
FIG. 3 is a perspective exploded view according to FIG. 2.

Please refer to FIGS. 2 and 3. The rotary bar 20 of the present invention includes an inner bar 30, an outer bar 40 and at least one transmission means 50.

The inner bar 30 is slidably nested in the outer bar 40. When turning the inner bar 30, the outer bar 40 is synchronously rotated along with the inner bar.30. In order to achieve this object, the inner and outer bars are hollow bars having rectangular cross-section, whereby the two bars 30, 40 are slidable relative to each other and synchronously rotatable.

The inner bar 30 has a length shorter than that of the outer bar 40. One end of the inner bar 30 is a holding end 31 extending out from the outer bar 40. The holding end 31 is equipped with a handle 32 for easy grip. Two lateral faces of the inner bar are respectively formed with two slots 34 having a certain length. Two lateral faces of one end of the outer bar are respectively provided with two stop sections 42 which can be screws. The stop sections 42 respectively extend into the slots 34. When the inner bar is slid back and forth within the outer bar, the stop sections 42 stop two ends of the slots 34 and serve as dead ends of the travel of the inner bar.

Figure 4:
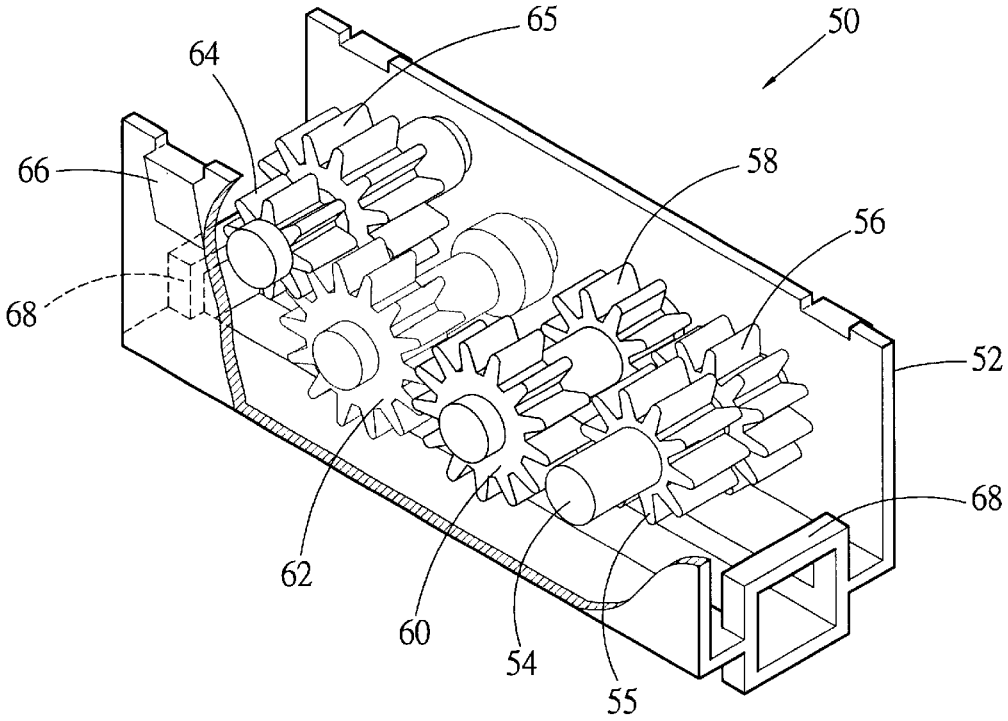
FIG. 4 is an enlarged view of the transmission means of FIG. 3.

In this embodiment, the transmission means 50 is a gear set disposed in a U-shaped casing 52. Referring to FIG. 4, the transmission means 50 includes four parallel shafts 54 and gears disposed on the shafts. The gear 55 is an input gear serving as an input end for inputting power. The gear 65 is an output gear serving as an output end for outputting power. The input gear 55 is coaxial with the gear 56. When the input gear is driven, via the gear 56, the gear 58 is driven. Further, via the gear 60 coaxial with the gear 58, the gear 62 is driven to further drive the gear 64. Accordingly, the output gear 65 coaxial with the gear 64 is rotated. In the transmission means 50, the larger gear drives the smaller gear so as to gradually increase the rotational speed. In this embodiment, the ratio of the rotational speed of the input gear 55 to that of the output gear 65 is 1:2.5. Therefore, each time the input gear is rotated by one circle, the output gear is rotated by two and half circles.

Figure 6:
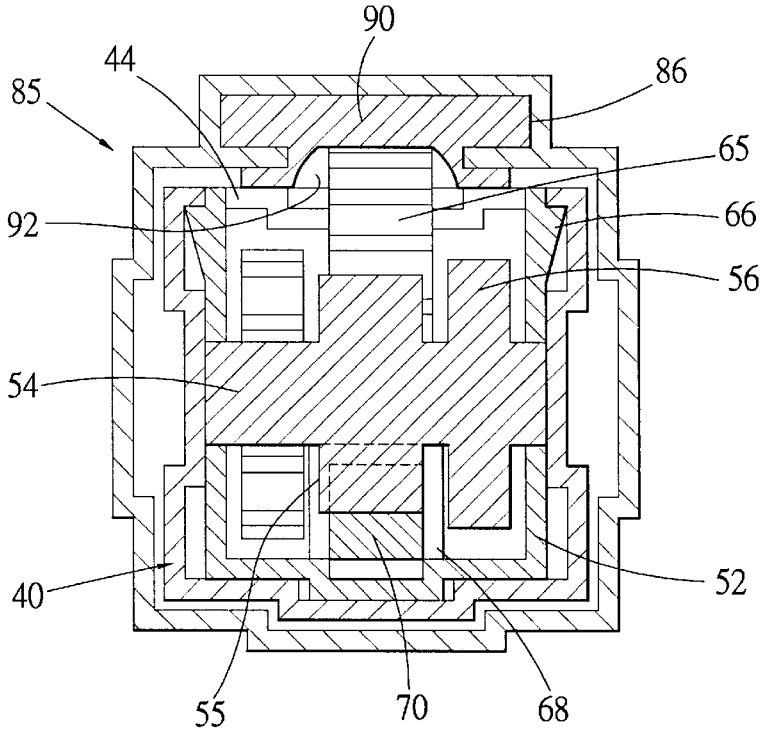
FIG. 6 is a cross-sectional view according to FIG. 2.
Figure 5:
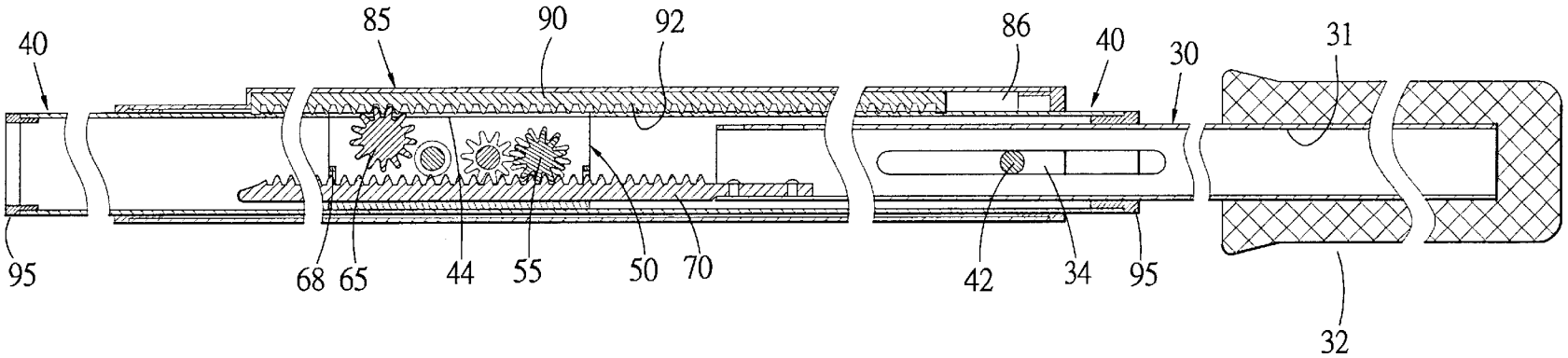
FIG. 5 is a longitudinal sectional view according to FIG. 2.

The transmission means 50 is installed and fixed in the outer bar 40 from a window 44 formed on one end of the outer bar 40 as shown in FIG. 5. In this embodiment, the engaging section 66 formed on outer wall of the casing 52 is engaged with the edge of the window 44 to locate the casing 52 in the outer bar 40 as shown in FIG. 6. The output gear 65 slightly protrudes out of the outer bar 40 through the window 44.

A first transmission body 70 which is a rack is connected with the inner bar 30. The first transmission body can be integrally formed with the inner bar. In this embodiment, the transmission body 70 and the inner bar are separately made. One end of the transmission body 70 is fixedly connected with inner end of the inner bar. The other end of the transmission body extends into the transmission means 50 to mesh with the input gear 55 as shown in FIGS. 5 and 6. The transmission body 70 is passed through two frames 68 disposed at two ends of the casing 52. The frames 68 serve to guide and hold the transmission body 70 and prevent the same from swinging left and right.

Several dolls 80 are slidably fitted on the outer bar. The dolls 80 are rotatable along with the outer bar. In the case that there are over two dolls fitted on the outer bar, the dolls can be synchronously displaced. In order to slide the dolls along the outer bar and rotate the dolls along with the outer bar, in this embodiment, a linking member which is a rectangular tubular slide rack 85 is fitted on the outer bar. The slide rack 85 has a length shorter than that of the outer bar and is slidable along the outer bar. As shown in,FIG. 2, each doll 80 is fixed on the slide rack 85 by a screw 82.

A second transmission body 90 which is a also a rack is disposed in an insertion channel 86 of the slide rack 85 as shown in FIGS. 5 and 6. The insertion channel 86 communicates with the interior of the slide rack, whereby the toothed face 92 of the transmission body 90 can mesh with the output gear 65 of the transmission means 50.

In addition, two ends of the outer bar 40 and the slide rack 85 are provided with end caps 95 to space the slide rack 85 from the outer bar 40 and space the outer bar from the inner bar 30 by a certain gap and thus reduce contacting area and enhance sliding ability.

FIG. 2 is an assembled view of the present invention, in which one or more dolls 80 are mounted on the slide rack 85.

Figure 7:
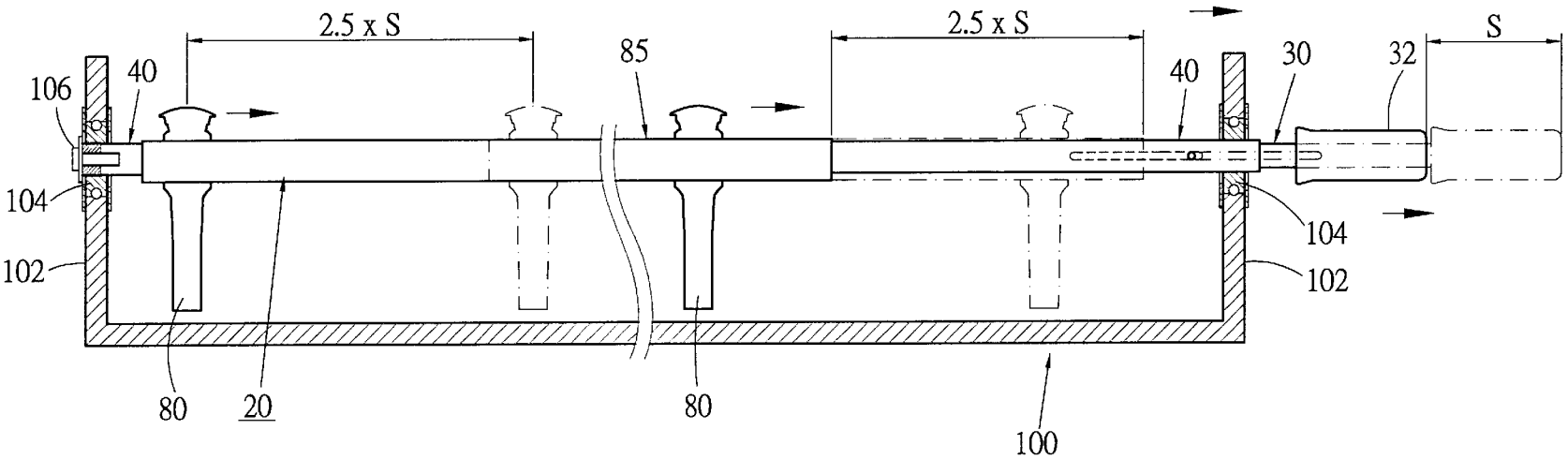
FIG. 7 shows an application of the present invention.

The rotary bar 20 is mounted on a soccer table or a hockey table. FIG. 7 shows that the rotary bar is mounted on a soccer table 100. Two ends of the outer bar 40 are passed through two sides of the table frame 102. The table frame is provided with bearings 104 in which the outer bar is fitted, permitting the rotary bar to rotate. The tail end of the outer bar 40 is engaged with the table frame by a fixing member 106 to locate the outer bar on the table frame.

In use, as shown in FIG. 5, when the inner bar 30 is pulled from the holding end 31 thereof, the inner bar and the first transmission body 70 are slid within the outer bar 40. At this time, the first transmission body 70 drives the input gear 55 of the transmission means 50 to further drive the output gear 65 to rotate. The output gear 65 drives the second transmission body 90, making the slide rack 85 and the dolls 80 slide along the outer bar. The rotational speed of the output gear 65 is greater than that of the input gear 55. Therefore, the movement of the slide rack and the dolls is larger than the movement of the inner bar. In this embodiment, when the inner bar moves by travel S as shown in FIG. 7, the dolls move by a travel which is 2.5 times travel S. Therefore, the travel is magnified and the dolls can be quickly moved.

After the dolls are moved to the ball, a player can turn the inner bar. At this time, the outer bar, slide rack and dolls are synchronously rotated to kick the ball. It should.be noted that the bottom end of the doll 80 is formed with an arch face 84 for kicking up the ball.

Figure 8:
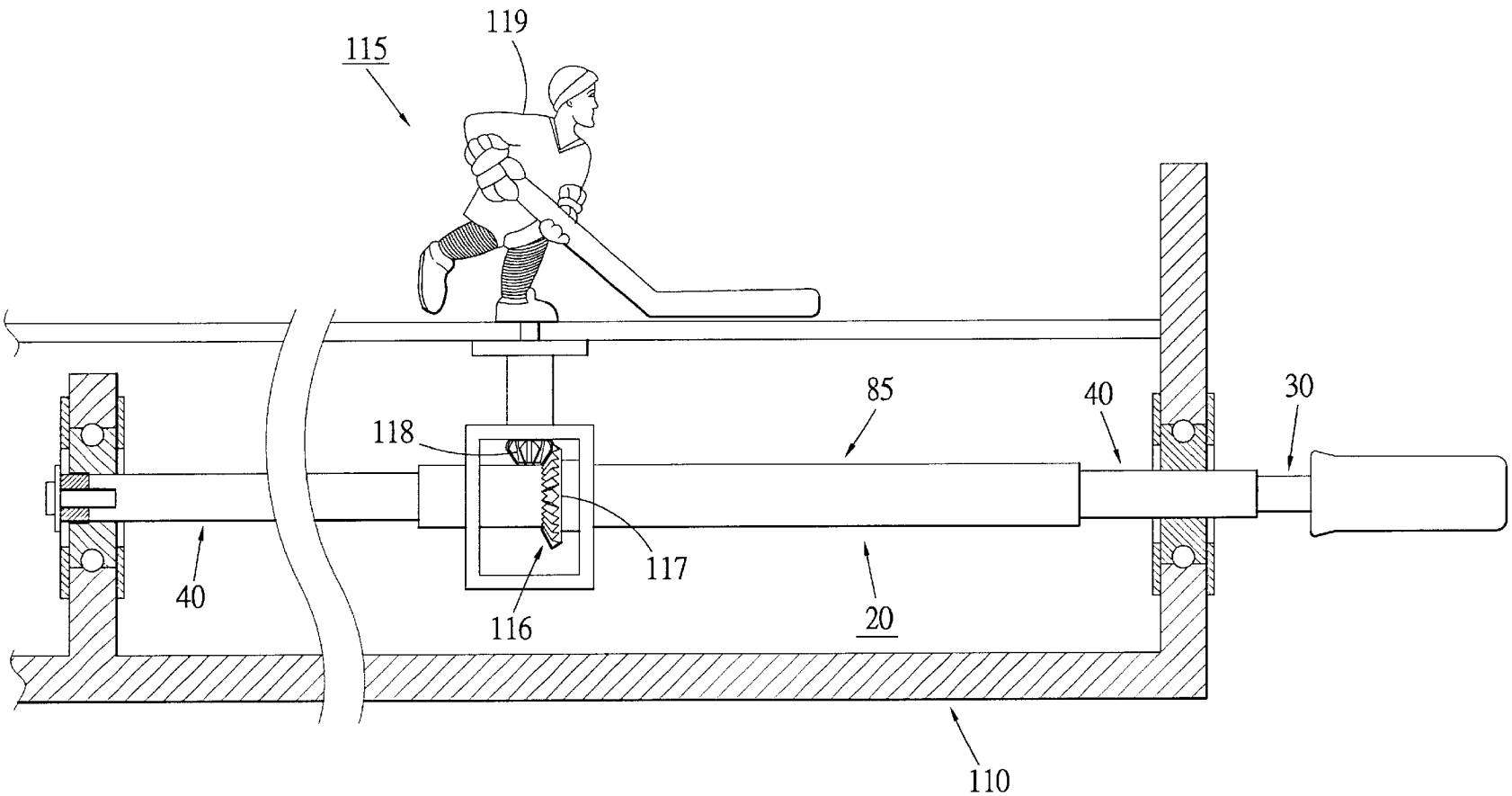
FIG. 8 shows another application of the present invention, in which the present invention is mounted in a hockey table.

FIG. 8 shows that the rotary bar 20 is mounted on a hockey table 110. The rotary bar is mounted in the table body with the tail end of the outer bar 40 fixed in the table body. The rotary mechanism 116 at the bottom end of the doll 115 is fixedly connected with the slide rack 85. A bevel gear 117 of the rotary mechanism 116 is fixedly fitted around the slide rack 85. When pulling the inner bar 30, the slide rack and the doll are driven and moved. When turning the rotary bar 20, the bevel gears 117 and 118 are rotated to rotate the doll 119 for driving the ball.

Figure 9:
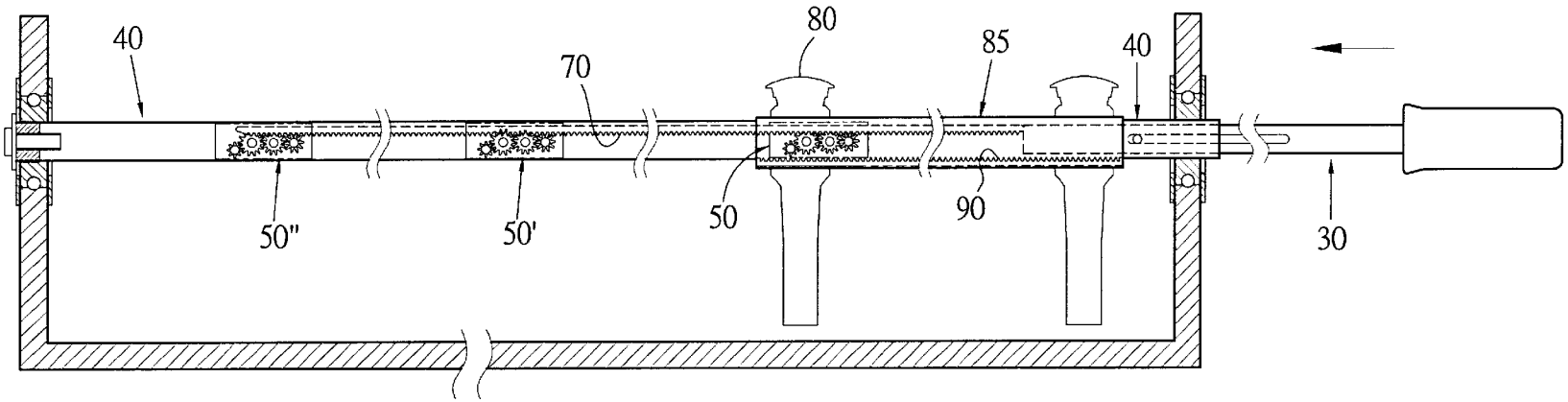
FIG. 9 is a longitudinal partially sectional view of another embodiment of the present invention.
Figure 10:
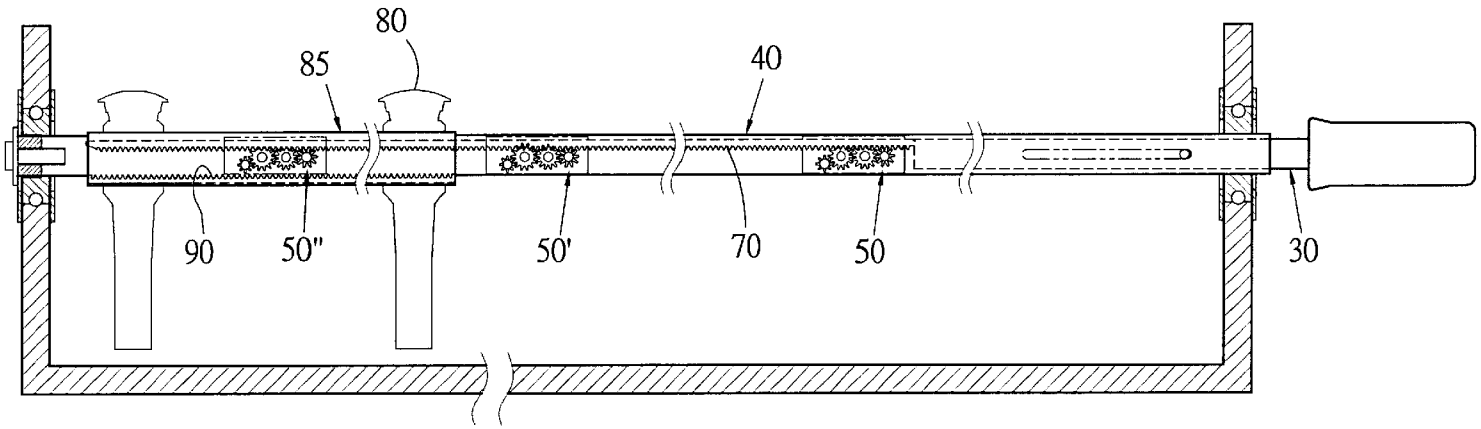
FIG. 10 shows an operation state according to FIG. 9.

FIG. 9 shows another embodiment of the present invention, in which three transmission means 50, 50', 50" are disposed in the outer bar 40 at intervals. In FIG. 9, the first transmission body 70 is engaged with all the transmission means 50, 50', 50", while the second transmission body 90 is only engaged with the first transmission means 50. When pushing the inner bar 30 to left side of FIG. 9, the three transmission means are synchronously driven. The second transmission body 90 together with the slide rack 85 are moved leftward from a position where the second transmission body meshes with the first transmission means 50. The second transmission body 90 then meshes with the second transmission means 50' and then further meshes with the third transmission means 50" as shown in FIG. 10. Accordingly, in the case that multiple transmission means are provided, the transmission means can successively drive the slide rack and the doll to increase the travel of the doll.

Figure 11:
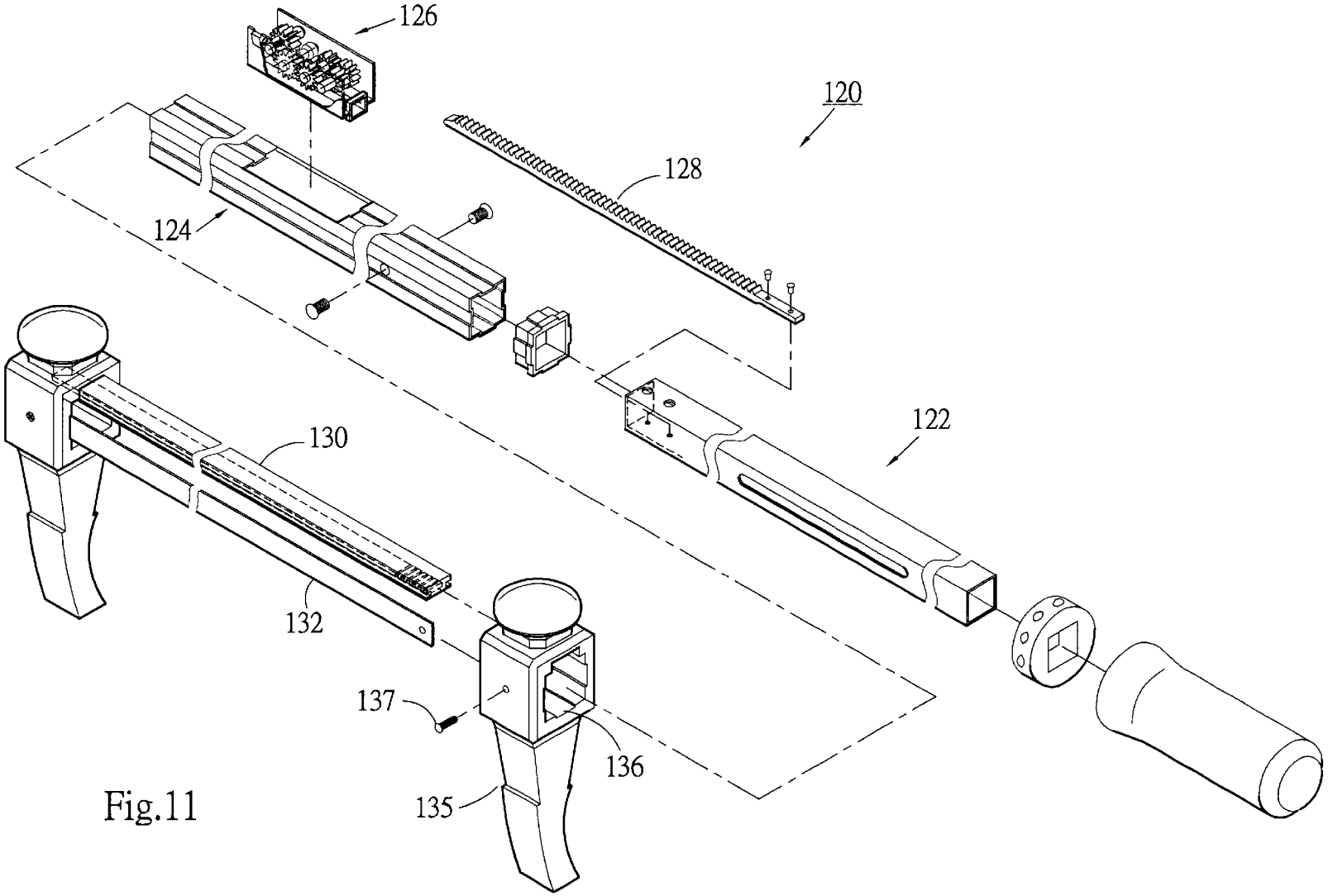
FIG. 11 is a perspective exploded view of still another embodiment of the present invention.
Figure 12:
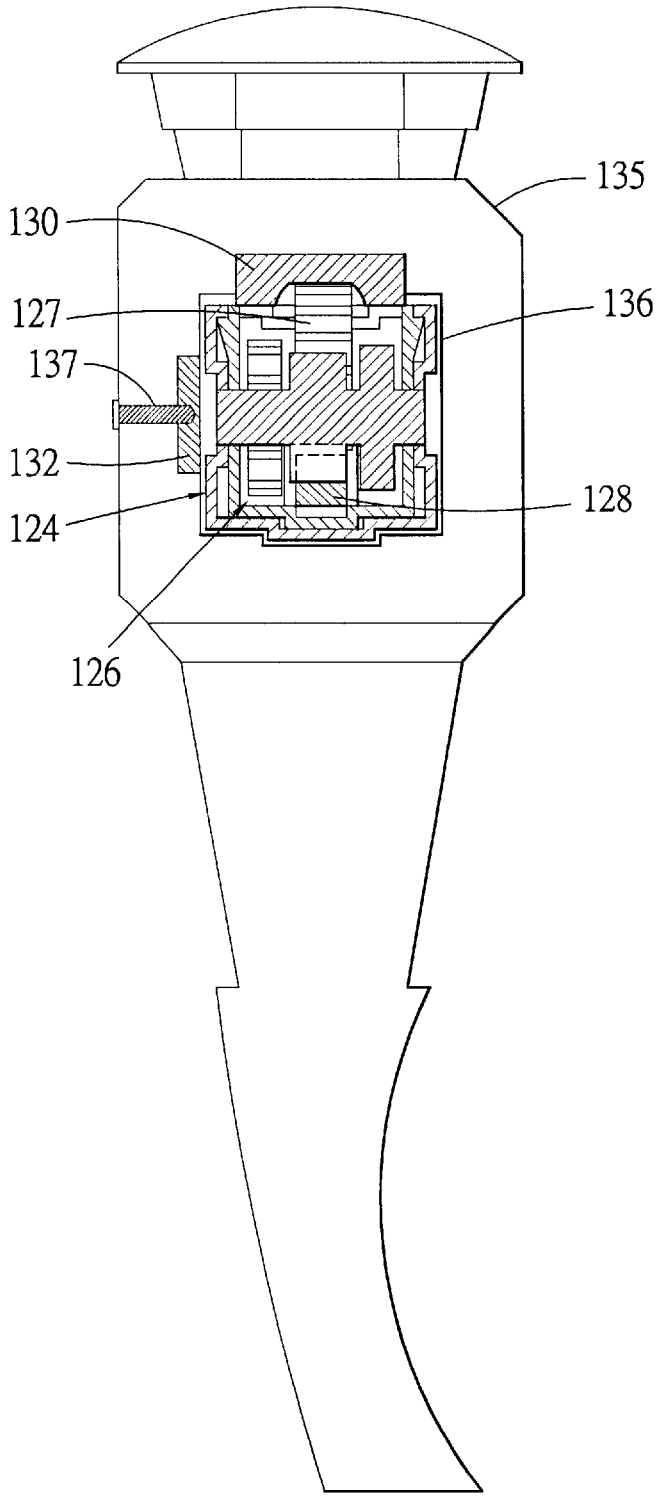
FIG. 12 is a sectional assembled view according to FIG. 11.

FIGS. 11 and 12 show still another embodiment of the present invention, in which the inner bar 122, outer bar 124, transmission means 126 and the first and second transmission bodies 128, 130 of the rotary bar 120 are identical to those of the above embodiment. The dolls 135 are directly fitted around the outer bar 124 through the fitting holes 136. The dolls are slidable along the outer bar and rotatable along with the outer bar. The second transmission body 130 is directly fixed on inner wall of the fitting hole 136 to mesh with the output gear 127 of the transmission means 126.

Similarly, when the inner bar 122 is pulled to make the first transmission body 128 drive the transmission means 126, the second transmission body 130 is driven to move the doll 135 along the outer bar 124. In the case that there are over two dolls 135, the second transmission body 130 is fixedly connected with the dolls to synchronously move the dolls. In addition, a link 132 can be connected between the dolls to enhance stability of the dolls during sliding.

Figure 13:
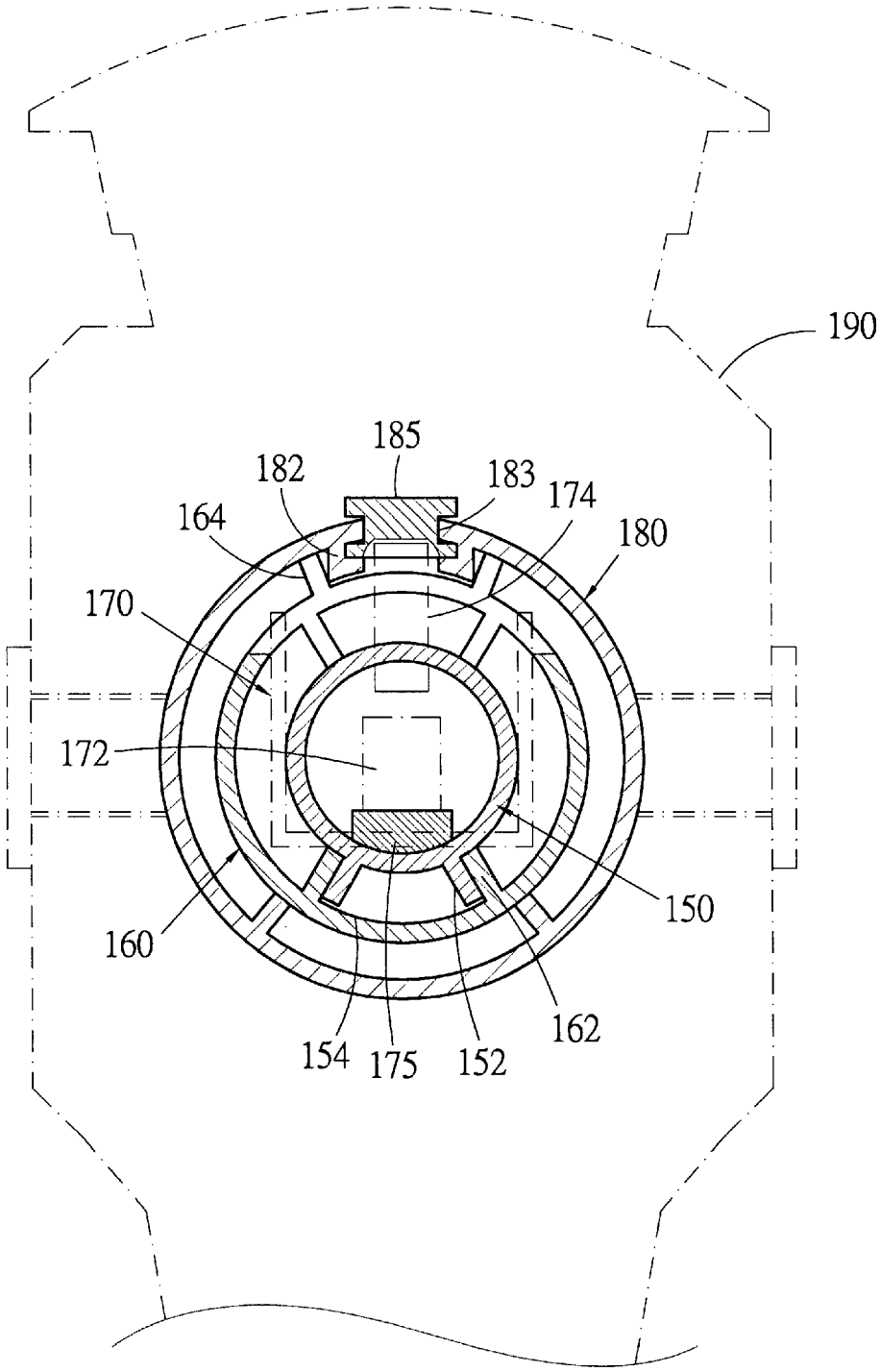
FIG. 13 is a sectional view of still another embodiment of the present invention.

Furthermore, the shape of the cross-section of the inner and outer bars is not limited to polygonal shape. In the embodiment of FIG. 13, the inner and outer-bars are tube bodies having circular cross-section. The inner and outer bars 150, 160 are formed with axial ribs 152, 162 engaged with each other. Accordingly, the inner bar is slidable within the outer bar and when the inner bar 150 is 9. rotated, the outer bar 160 is driven to synchronously rotate. The transmission means 170 is mounted in the outer bar. The first transmission body 175 is engaged with the input gear 172 of the transmission means 170. The slide rack 180 can be a circular tube slidably fitted around the outer bar 160. By means of engagement between the ribs 182 and 164, the slide rack 180 is rotatable along with the outer bar. The doll 190 is fixedly disposed around the slide rack 180. The second transmission body 185 is fixed in the insertion channel 183 of the slide rack and engaged with the output gear 174 of the transmission means.

Figure 14:
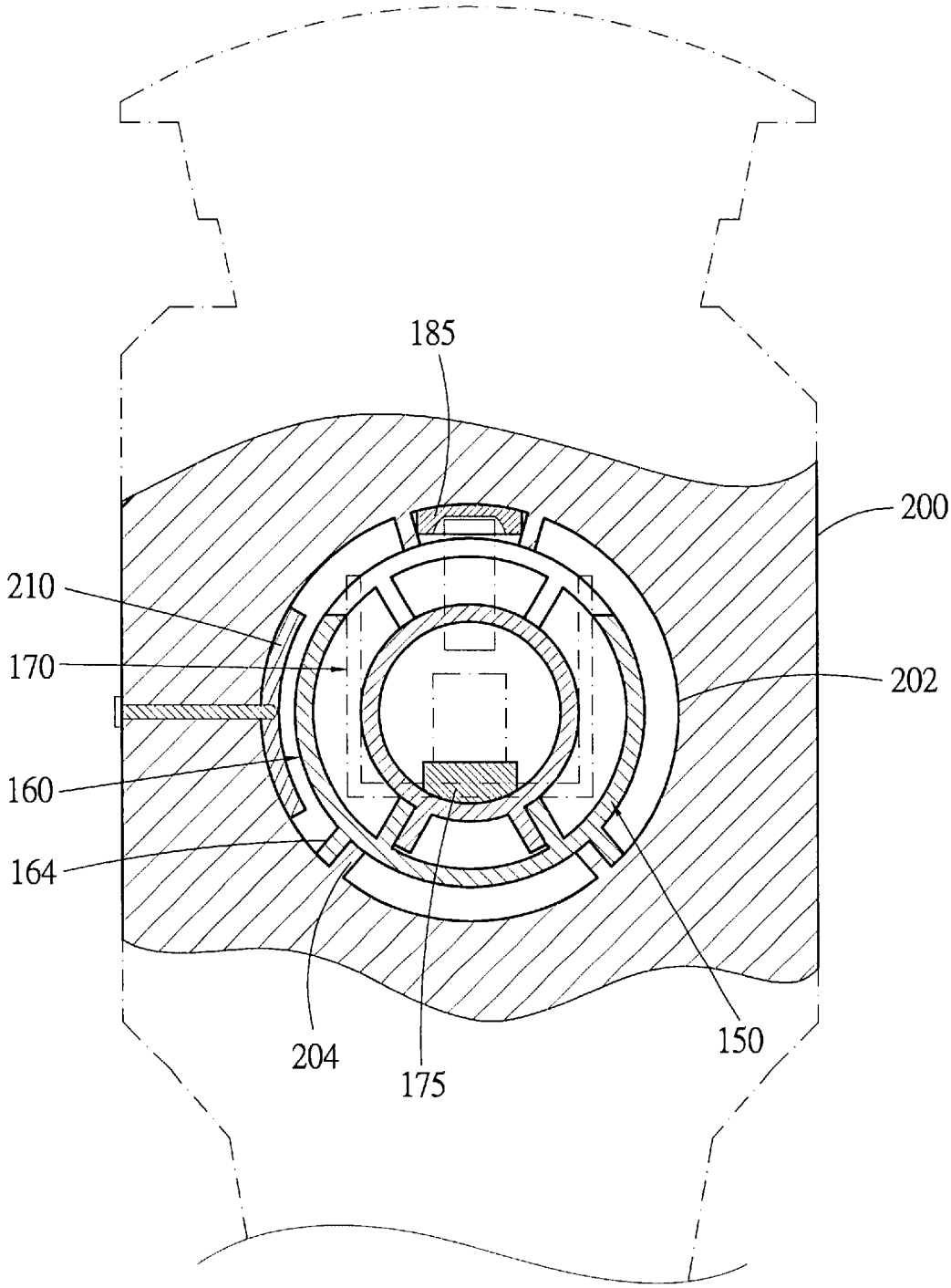
FIG. 14 is a sectional view of still another embodiment of the present invention.

FIG. 14 shows still another embodiment of the present invention, in which the slide rack is omitted and the inner bar 150, outer bar 160, transmission means 170 and first transmission body 175 are identical to those of the above embodiment. The doll 200 is directly slidably fitted around the outer bar 160 through a fitting hole 202. The inner wall of the fitting hole 202 and the outer bar are formed with ribs 204, 164 which are engaged with each other to enable the outer bar and the doll to synchronously rotate. The second transmission body 185 is fixed on inner wall of the fitting hole 202 and engaged with the transmission means 170. In the case that there are over two dolls, a link 210 can be connected between the dolls.

According to the above arrangements, the travel of the doll is magnified to be much longer than the travel of the inner bar operated by a player. Accordingly, the moving speed and movement of the doll are increased and the sensitivity of operation is enhanced.

Moreover, the operation distance is smaller than the movement of the doll so that the extending length of the holding end of the inner bar from the table body is greatly shortened. Also, the tail end of the rotary bar (that is, the tail end of the outer bar) is fixed in the other side of the table frame without protruding therefrom. Therefore, when using the game table, the necessary reserved space on two sides of the table body is reduced.The above advantages enable manufacturers to develop larger game tables.

The above embodiments are only used to illustrate the present invention, not intended to limit the scope thereof. Many modifications of the above embodiments can be made without departing from the spirit of the present invention. For example, the first and second transmission bodies can be disposed on the same side of the rotary bar rather than respectively disposed on upper and lower sides thereof. Also, the number of the gears of the transmission means can be increased or decreased or designed with different rotational speed ratio. In addition, the slide rack can be modified to have otherwise configuration.

What is claimed is:

1. A rotary bar for a game table, comprising:

an inner bar;

a hollow outer bar in which the inner bar is slidably nested, one end of the inner bar extending out of the outer bar for holding, two ends of the outer bar being mounted on a table body of the game table, whereby when turning the inner bar, the outer bar and the inner bar are synchronously rotated;

at least one transmission means disposed in the outer bar and having a power input end and a power output end, the inner end of the inner bar being connected with the power input end, whereby when the inner bar is slid, the moving power of the inner bar via the input end is transmitted to the output end; and at least one doll slidably fitted around the outer bar, when the outer bar is rotated, the doll being synchronously rotated with the outer bar, the power output end of the transmission means serving to drive the doll to move along the outer bar, whereby when operating the inner bar to slide, the doll is driven and moved and when turning the inner bar, the doll is rotated.

2. The rotary bar for the game table as claimed in claim 1, wherein the inner bar is provided with a first transmission body connected with the power input end, the doll being provided with a second transmission body connected with the power output end.

3. The rotary bar for the game table as claimed in claim 2, wherein the doll is formed with a fitting hole through which the outer bar passes, the second transmission body being disposed on the inner wall of the fitting hole.

4. The rotary bar for the game table as claimed in claim 2, wherein the two transmission bodies are elongated strips in parallel to the axis of the rotary bar.

5. The rotary bar for the game table as claimed in claim 4, wherein the doll is formed with a fitting hole through which the outer bar passes, the second transmission body being fixedly disposed on the inner wall of the fitting hole along the axis of the rotary bar.

6. The rotary bar for the game table as claimed in claim 4, wherein the first transmission body is integrally formed with the inner bar and the second transmission body is integrally formed with the doll.

7. The rotary bar for the game table as claimed in claim 4, wherein one end of the first transmission body is connected with the inner bar, while the other end thereof is engaged with the transmission means, the second transmission body being connected with the doll.

8. The rotary bar for the game table as claimed in claim 2, wherein the transmission means is a gear set including several gears engaged with each other, a gear positioned at one end serving as the power input end, a gear positioned at the other end serving as the power output end, the two transmission bodies being two racks respectively meshing with the input end and output end.

9. The rotary bar for the game table as claimed in claim 8, wherein the rotational speed of the power output end is greater than the rotational speed of the power input end.

10. The rotary bar for the game table as claimed in claim 8, wherein the transmission means further includes a casing in which the gears are mounted, the casing being disposed in the outer bar.

11. The rotary bar for the game table as claimed in claim 10, wherein the outer bar is formed with at least one window, the transmission means being mounted in the outer bar through the window.

12. The rotary bar for the game table as claimed in claim 11, herein an outer wall of the casing is formed with a predetermined number of engaging sections for engaging with an inner wall of the outer bar.

13. The rotary bar for the game table as claimed in claim 10, wherein the at least one end of the casing is formed with a small frame, whereby the first transmission body extends through the small frame into the transmission means.

14. The rotary bar for the game table as claimed in claim 1, wherein the transmission means serves to convert the transmitted power, whereby the power of the power input end is unequal to the power of the power output end.

15. The rotary bar for the game table as claimed in claim 1, wherein when operating the inner bar to slide, the movement of the doll is larger than the movement of the inner bar.

16. The rotary bar for the game table as claimed in claim 1, wherein when the inner bar is slid within the outer bar, the inner bar is stoppable at a dead end.

17. The rotary bar for the game table as claimed in claim 16, wherein the circumference of the inner bar is formed with an axial slot, at least one stop section being disposed on the outer bar and extending into the slot.

18. The rotary bar for the game table as claimed in claim 16, wherein the circumference of the outer bar is formed with an axial slot, at least one stop section being disposed on the inner bar and extending into the slot.

19. The rotary bar for the game table as claimed in claim 1, wherein the inner and outer bars are polygonal bar bodies, the inner bar being nested in the outer bar.

20. The rotary bar for the game table as claimed in claim 1, wherein the inner and outer bars are circular tube bodies, the inner bar being nested in the outer bar, the wall faces of the inner and outer bars being formed with engaging sections engaged with each other, whereby the inner and outer bars can be synchronously rotated.

21. The rotary bar for the game table as claimed in claim 20, wherein the inner wall of the outer bar and the outer wall of the inner bar are formed with axial ribs which are engaged with each other.

22. The rotary bar for the game table as claimed in claim 1, further comprising at least one link connecting the doll.

23. The rotary bar for the game table as claimed in claim 1, further comprising a linking means slidably fitted around the outer bar, the linking means being rotatable along with the outer bar, the doll being fixedly connected with the linking means, the power output end of the transmission means serving to drive the linking means to slide along the outer bar so as to drive the doll to move.

24. A rotary bar for a game table, comprising:

an inner bar;

a hollow outer bar in which the inner bar is slidably nested, one end of the inner bar extending out of the outer bar for holding, two ends of the outer bar being mounted on a table body of the game table, whereby when turning the inner bar, the outer bar and the inner bar are synchronously rotated;

at least one transmission means disposed in the outer bar and having a power input end and a power output end, the inner end of the inner bar being connected with the power input end, whereby when the inner bar is slid, the moving power of the inner bar via the input end is transmitted to the output end; and a linking means slidably fitted around the outer bar, the linking means being rotatable along with the outer bar, at least one doll being fixed on the linking means, the power output end of the transmission means serving to drive the linking means to slide along the outer bar, whereby when operating the inner bar to slide, via the linking means, the doll is driven and moved and when turning the inner bar, via the linking means, the doll is rotated.

25. The rotary bar for the game table as claimed in claim 24, wherein the transmission means serves to convert the transmitted power, whereby the power of the power input end is unequal to the power of the power output end.

26. The rotary bar for the game table as claimed in claim 24, wherein the linking means is a hollow tubular slide rack.

27. The rotary bar for the game table as claimed in claim 24, wherein the inner bar is provided with a first transmission body connected with the power input end, the linking means being provided with a second transmission body connected with the power output end.

28. The rotary bar for the game table as claimed in claim 27, wherein the two transmission bodies are elongated strips in parallel to the axis of the rotary bar.

29. The rotary bar for the game table as claimed in claim 22, wherein the transmission means is a gear set including several gears engaged with each other, a gear positioned at one end serving as the power input end, a gear positioned at the other end serving as the power output end, the two transmission bodies being two racks respectively meshing with the input end output end.

30. The rotary bar for the game table as claimed in claim 29, wherein the rotational speed of the power output end is greater than the rotational speed of the power input end.

31. The rotary bar for the game table as claimed in claim 29, wherein the transmission means further includes a casing in which the gears are mounted, the casing being disposed in the outer bar.

32. The rotary bar for the game table as claimed in claim 31, wherein the outer bar is formed with at least one window, the transmission means being mounted in the outer bar through the window.

33. The rotary bar for the game table as claimed in claim 32, wherein an outer wall of the casing is formed with a predetermined number of engaging sections for engaging with an inner wall of the outer bar.

34. The rotary bar for the game table as claimed in claim 31, wherein at least one end of the casing is formed with a small frame, whereby the first transmission body extends through the small frame into the transmission means.

35. The rotary bar for the game table as claimed in claim 24, wherein when operating the inner bar to slide, the movement of the linking means is larger than the movement of the inner bar.

36. The rotary bar for the game table as claimed in claim 24, wherein when the inner bar is slid within the outer bar, the inner bar is stoppable at a dead end.

37. The rotary bar for the game table as claimed in claim 24, wherein the inner bar and the outer bar and the linking means are polygonal bar bodies; the outer bar being nested in the linking means.

38. The rotary bar for the game table as claimed in claim 24, wherein the inner and outer bars and the linking means are circular tube bodies fitted with each other, the wall faces of the inner and outer bars and the linking means being formed with engaging sections engaged with each other, whereby the inner and outer bars and the linking means can be synchronously rotated.

39. The rotary bar for the game table as claimed in claim 38, wherein the inner and outer walls of the outer bar and the outer wall of the inner bar and the inner wall of the linking means are formed with axial ribs which are engaged with each other.

40. The rotary bar for the game table as claimed in claim 28, wherein the linking means is an elongated body fitted around the outer bar, an inner wall of the linking means being formed with an axial insertion channel in which the second transmission body is disposed.

41. The rotary bar for the game table as claimed in claim 28, wherein the second transmission body is integrally formed with the linking means and the first transmission body is integrally formed with the inner bar.

42. The rotary bar for the game table as claimed in claim 28, wherein one end of the first transmission body is connected with the inner bar, the other end thereof is engaged with the transmission means.

* * * * *